United States Patent [19]

De Larm

[11] Patent Number: 4,516,563

[45] Date of Patent: May 14, 1985

[54] HEATING DEVICE

[76] Inventor: James B. De Larm, Summit Dr., Hague, N.Y. 12836

[21] Appl. No.: 583,189

[22] Filed: Feb. 24, 1984

Related U.S. Application Data

[63] Continuation-in-part of Ser. No. 475,255, Mar. 14, 1983, abandoned.

[51] Int. Cl.[3] ..... F24D 9/00

[52] U.S. Cl. ..... 126/101; 126/119; 126/362; 237/66; 110/234; 110/336

[58] Field of Search ..... 126/119, 114, 98, 64, 126/101, 8, 53, 34, 365, 362, 61, 63, 66, 67; 110/234, 336; 237/66, 61, 62, 59, 18, 16; 122/18; 219/38.8

[56] References Cited

U.S. PATENT DOCUMENTS

| | | | |
|---|---|---|---|
| 238,077 | 2/1881 | Balkus | 126/101 |
| 352,908 | 11/1886 | Barker | 237/66 |
| 372,249 | 10/1887 | Blake | 126/101 |
| 498,057 | 5/1893 | Howard | 126/101 |
| 556,098 | 3/1896 | Johnson et al. | 126/119 |
| 564,804 | 7/1896 | Steinhoff | 126/01 |
| 753,011 | 2/1904 | Steyne | 126/101 |
| 1,658,412 | 2/1928 | Parker | 237/66 X |
| 2,482,746 | 9/1949 | Crozier | 126/101 /X |
| 4,136,664 | 1/1979 | Folsom | 126/64 |
| 4,157,704 | 6/1979 | Zimmer | 126/62 |
| 4,323,051 | 4/1982 | Auerbach et al. | 126/101 |

*Primary Examiner*—Randall L. Green

*Attorney, Agent, or Firm*—Walter F. Wessendorf, Jr.

[57] ABSTRACT

Disclosed is a heating device of assembled cast panel construction with flanges joined together and whose front, side, back and top walls and bottom grates define a combustion chamber. The angled side walls define an obtuse interior angle and the side and top walls define an obtuse interior angle. An embodiment of the heating device is a boiler incorporated by operatively connected expansion tank, holding tank and a coil of water tubes disposed in the combustion chamber's top area. Another embodiment of the heating device is a hot-air furnace incorporated by a plenum chamber, cold-air return and blower fan with such blower fan directing cold air from the cold-air return to and through the plenum chamber where it is heated. A still further embodiment combines the boiler and hot-air furnace with such heating device.

12 Claims, 6 Drawing Figures

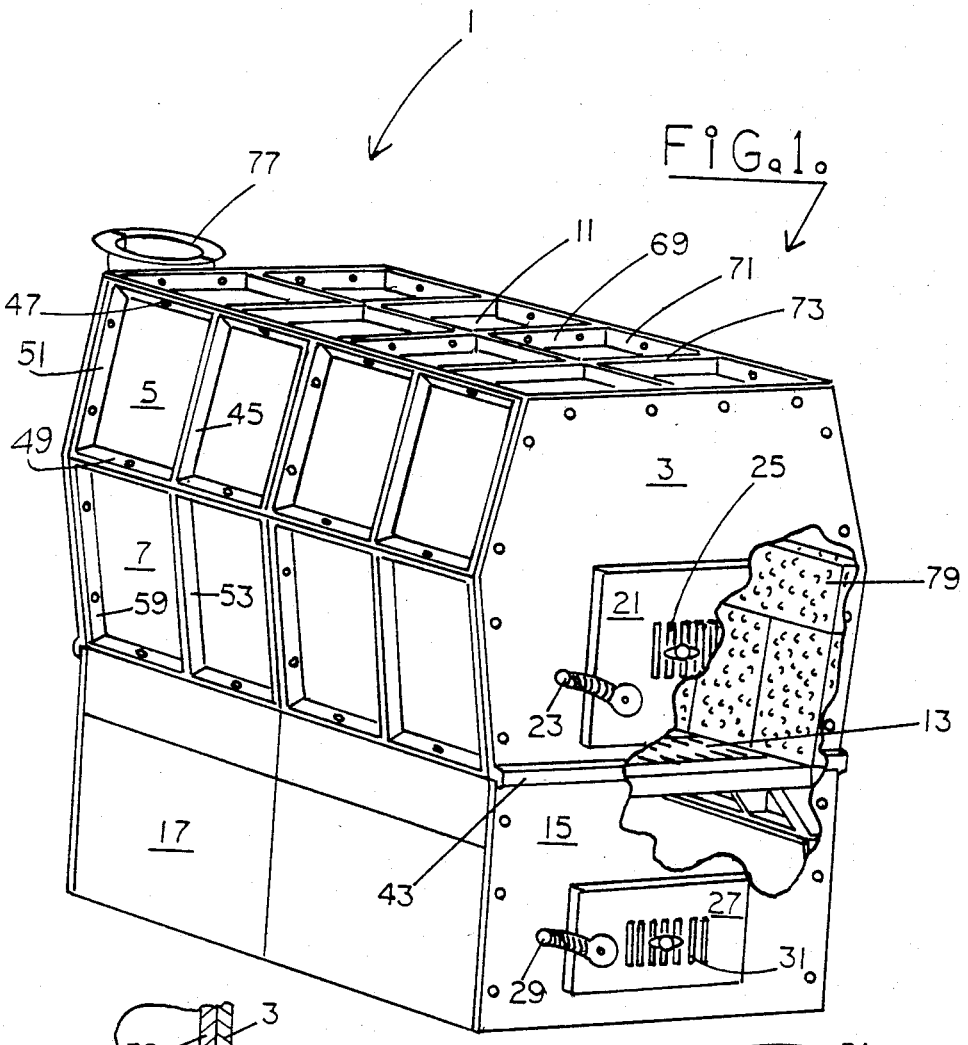
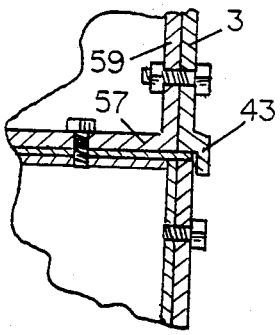
FIG. 1.A.
FIG. 1.B.
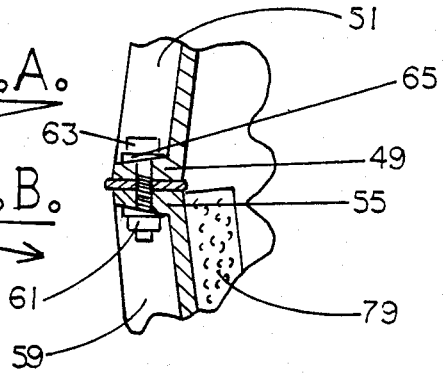

105
119
117
115
109
111
107
113

HEATING DEVICE

This application is a continuation-in-part with respect to the earlier filed pending application, Ser. No. 475,255, filed Mar. 14, 1983, now abandoned.

BACKGROUND OF THE INVENTION

1. Technical Field

This invention relates to a heating device of assembled cast panel construction of cast iron or other suitable material.

2. Background Art

Relevant prior art is represented by the following enumerated U.S. Pat. Nos., to wit: 556,098 (Johnson et al.); 564,804 (Steinhoff); and 4,232,051 (Auerbach et al.).

Steinhoff has a cylindrical firebox comprised of a lower section which is divergent and an upper section which is convergent and terminates in a dome. Steinhoff lacks Applicant's structure of upper and lower side cast panels which present and define flat surfaces inwardly facing Applicant's combustion chamber. Steinhoff lacks fire brick, whereas Applicant has fire brick emplaced in diverging relationship with his lower side cast panels to reflect heat upward. Applicant has a flat top wall, whereas Steinhoff has a dome. Applicant stops the heat at his flat top wall to further concentrate and maintain the heat in the upper combustion chamber half. Steinhoff does not predicate any functional attribute whatsoever to the shape of his fire box. Applicant's heating device is 40% to 50% more effective in forcing the heat to concentrate and maintain itself in the upper half of his combustion chamber above the creosote deposition temperature so that creosote will not form from the flue gases.

Certified on-going inspections by impartial experts with respect to Applicant's heating device—embodied as having side walls which diverge upwardly and outwardly, then converge upwardly and inwardly, and joined by a top wall that has a horizontal flat surface that inwardly faces the combustion chamber, with the surfaces of the side walls which inwardly face the combustion chamber being flat as well, and with a water boiler tube arrangement located in the upper half of the combustion chamber—confirm that the structure of Applicant's heating device is unique in that such flat top wall further concentrates and maintains the heat in the upper combustion chamber half; that this structural feature is 40% to 50% more effective (as compared, for example, to a dome-like structure) in forcing the heat to concentrate and maintain itself in the upper half of Applicant's combustion chamber with the functional result that Applicant's heating device maintains itself above the creosote deposition temperature; and such on-going inspections have confirmed that there is no evidence of creosote in the interior of Applicant's heating device nor in the chimney operatively connected with Applicant's heating device.

In Johnson et al., the title is misleading as to the same being a furnace for the reason that their structure is not a furnace per se, but rather an attachment or insert for the inner sidewalls of a sheet metal furnace-casing (see page 1, column 1, lines 13–18). Johnson et al. has concave-convex inner metallic lining-plates which define air-circulating chambers to prevent burnout and burnthrough of the sheet metal furnace-casing wall. No heat is reflected upward in Johnson et al., nor is any heat concentrated because of the semi-circular configuration. Johnson et al. further differs structurally from Applicant's heating device in that Applicant's lower side cast panels diverge upwardly, whereas in Johnson et al. the lower side cast panels converge upwardly. In Johnson et al., the inventors were confronted with the problem of burnout of the metallic sides of their furnace-casing laterally at the edges of their grates (page 1, lines 13–18, lines 58–67, lines 74–93) at which locus the intense fire would cause the most damage. Their lining-plates have air-circulating notches to ventilate the chambers formed by the lining-plates and their furnace-casing and allow a continuous circulation of air therethrough from the ashpit. Because Johnson et al. keep their furnace-casing cool to prevent lateral burnout and burnthrough, creosote will be formed in the region of their air-circulating notches. Contrastingly, the structure, arrangement and use of Applicant's diverging fire brick lying against his lower side cast panels are not to lower the temperature but to reflect such heat upward where same is forced to be concentrated and maintained by Applicant's converging upper side cast panels and with such heat being further concentrated and maintained by Applicant's flat top wall. As compared to the semi-circular interior wall surface in Johnson et al., Applicant defines his top wall as having top cast panels joined together to present a horizontal flat surface inwardly facing his combustion chamber. Applicant's top flat inward surface defines and subtends an obtuse angle with each of the flat inward surfaces of the upper side cast panels. The flat inward surface of each upper side cast panel defines and subtends an obtuse angle with each flat inward surface of each of the lower side cast panels.

Auerbach et al. have a coal-burning furnace or boiler comprising simply welded steel plates defining a combustion chamber protected by fire brick with a horizontally disposed water tube configuration which functions as a baffle to provide and effect 180° change in direction of the heat and products of combustion in one direction along the bottom of the water tubes and then to reverse the heat flow direction along and upon the top of the water tubes. In Auerbach et al. the walls are square and vertical, no heat is directed upwardly from their fire brick because the walls and fire brick are all vertically disposed. In Auerbach et al. the reason their fire brick are vertically disposed against their upper and lower firebox halves is not to reflect heat upward as claimed by Applicant, but rather to prevent burnout of their firebox halves.

As a matter of fact, sheet metal devices available buckle and render because of temperature changes. Because of their welded construction, there is no give to the sheet metal upon expansion and contraction. Consequently, such heating devices warp drastically and burn out within two to three years of use.

The object of the invention is to provide and dispose in the top area of the combustion chamber a coil of layers of connected steel water tubes operatively connected to a holding tank and expansion tank functioning as a boiler. The holding tank and expansion tank are located external of and above the heating device. The experimental model of such boiler demonstrates that creosote build-up in the heating device is significantly reduced, and in fact such on-going inspections certify the heating device to be creosote free, because the angled side walls function to reflect heat upward off the fire brick and to force such heat to concentrate in the smaller area at the top of the combustion chamber where the coil of water tubes is disposed and located, thereby heating water more quickly and efficiently. Moreover, the cooperating flat top wall structure further stops the heat to further and significantly aid in concentrating and maintaining the heat in the upper combustion chamber. Accordingly, the internal heat in such water-tube coil is maintained far above the critical 270° F. temperature of creosote deposition from the flue gases. In addition, because of the cast construction of the heating device, heat is maintained at a more constant level longer, thereby further preventing creosote from forming. Furthermore, with the holding tank external of the heating device, any effect of such holding tank in lowering the internal operating temperature of the boiler below the critical 270° F. creosote deposition temperature is eliminated. Another object of this invention is to contribute to the solution of the problem encountered with sheet metal heating devices by providing a heating device of assembled cast panel construction. These castings of iron or other suitable material will expand separately, independent of each other and of one another, and as much as a thirty-second of an inch to a square foot of surface panel depending upon where a particular panel casting is located in the assembled heating device. Naturally, the unprotected cast panels in the top area of the combustion chamber get much hotter than the cast panels in the lower area of the combustion chamber protected by fire brick, and comparatively hotter than the panels defining the ashpit. Such cast panels can expand and contract with the extreme temperature changes in the combustion chamber. By practicing this invention and using separate, smaller cast panels, the problem is eliminated and the heating device will have a much longer stove life, perhaps as long as 30 to 40 years.

BRIEF DESCRIPTION OF THE DRAWINGS

These objects and other objects of the invention should be discerned and appreciated by reference to the drawings, wherein like reference numerals refer to similar parts throughout the several views, in which:

FIG. 1 is a perspective view of the radiant heating device;

FIG. 1.A. is a fragmentary view of the lapover joint;

FIG. 1.B. is a fragmentary view of an assembled joint of the upper and lower side cast panels;

DESCRIPTION OF THE PREFERRED EMBODIMENT

Figure 2:
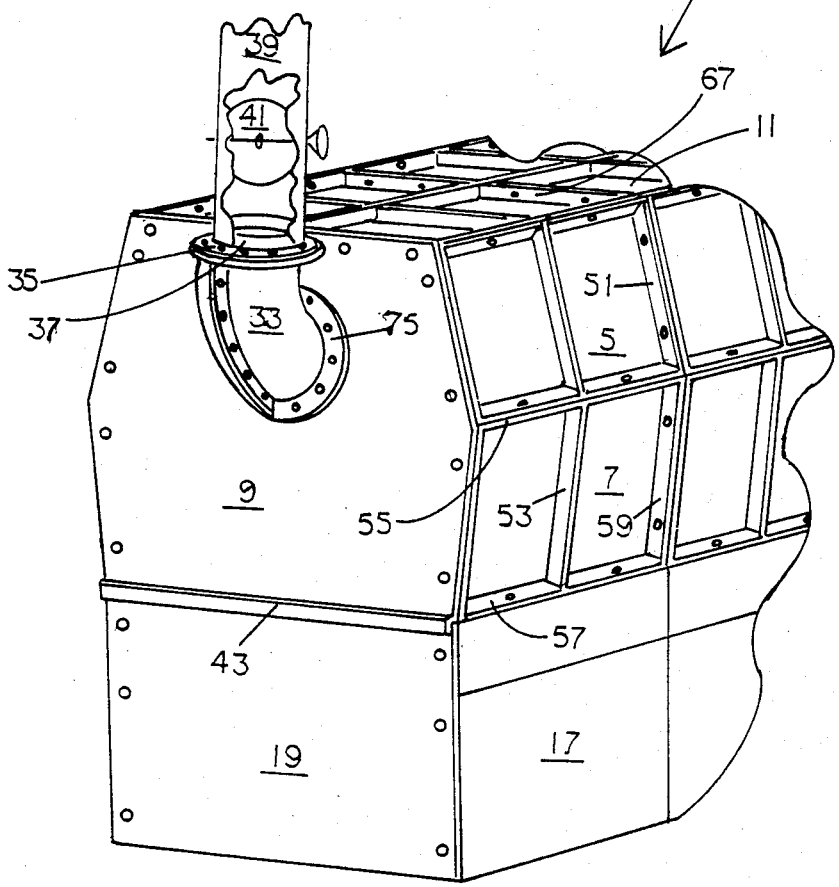
FIG. 2 is another perspective view of the radiant heating device.

To facilitate understanding the invention, a nomenclature list is herewith provided:

1 generally refers to the invention of the radiant heating device
3 upper front cast plate
5 upper side cast panel
7 lower side cast panel
9 upper back cast plate
11 top cast panel
13 grates
15 lower front cast plate
17 lower side panel
19 lower back cast plate
21 front door or feed door in front plate 3
23 latch handle on door 21
25 manual draft control in door 21
27 ashpit door
29 latch handle on door 27
31 manual draft control in door 27
33 elbowed flue on back plate 9
35 cast ring mounted on flue 33
37 male lip on cast ring 35
39 smoke pipe
41 in-line damper on smoke pipe 39
43 lapover joint on cast plate 3
45 central webbing on panel 5
47 upper flange of panel 5
49 lower flange of panel 5
51 lateral flange of panel 5
53 central webbing of panel 7
53 upper flange of panel 7
57 lower flange of panel 7
59 lateral flange of panel 7
61 nut
63 bolt
65 tapered washer
67 front flange of top panel 11
69 rear flange of top panel 11
71 tapered lateral flange of top panel 11
73 criss-crossed webbing of top panel 11
75 flanged joint on one end of elbowed flue 33
77 flanged joint on other end of elbowed flue 33
79 fire brick
81 generally refers to hot-water boiler
83 coil of layers of connected water tubes
85 holding tank
87 expansion tank
89 cold-water pipe interconnecting holding tank 85 and coil 83
91 incoming cold-water supply line
93 pipe interconnecting holding tank 85 and expansion tank 87
95 pipe connecting radiation system
97 dip tube
99 pressure relief valve
101 pipe from bottom layer of coil 83 through boiler wall
103 dump drain valve
105 generally refers to hot-air furnace
107 sheet-metal plenum
109 plenum chamber
111 cold-air return
113 blower fan
115 square collar
117 upstanding male vertical lip
119 leader In FIG. 1 of the drawings, reference numeral 1 generally refers to the invention of the radiant heating device of assembled panel construction.

Radiant heating device 1 comprises an upper front cast plate 3, upper and lower side cast panels 5 and 7, upper back cast plate 9, top cast panels 11 and grates 13 defining a combustion chamber or firebox; and a lower front cast plate 15, lower side panels 17 and lower back cast plate 19 defining an ashpit.

Upper front cast plate 3 has a conventional front door or feed door 21 that is hinged. By unlatching handle 23 and opening feed door 21, the combustion chamber can be loaded with a charge of wood or coal. Feed door 21 has a manual draft control 25 that is appropriately regulated to supply fresh air when burning coal.

The lower front cast plate 15 has a conventional ashpit door 27 that is hinged. By unlatching handle 29 and opening ashpit door 27, access is gained to the ashpit to remove ashes therefrom. Ashpit door 27 has a manual draft control 31 that is appropriately regulated to supply fresh air when burning coal or wood in the combustion chamber.

The upper back cast plate 9 carries an elbowed flue 33 that communicates with the combustion chamber and by means of which smoke, flue gases and products of combustion exit therethrough. Flue 33 mounts a smoke pipe cast ring 35 with a complemental male lip 37 received in and thereby mounting a vertically disposed smoke pipe 39 controlled by an in-line damper 41.

The upper front cast plate 3 has a lapover joint 43 built into cast plate 3 at the bottom of the combustion chamber which allows a certain amount of slippage between the upper plate 3 and lower plate 15. Upper plate 3 gets extremely hot compared to lower plate 15 because upper plate 3 is defining the extremely hot combustion chamber whereas lower plate 15 is defining the comparatively cooler ashpit. Since plates 3 and 15 are made without webbing, such lapover joint 43 is necessary to allow for heat expansion pressures to dissipate. Such lapover joint 43 also prevents smoke and gases from combustion from escaping and employs there-between a sealing gasket of asbestos or other suitable material. Upper back cast plate 9 has a similarly constructed and functioning lapover joint 43 with respect to the lower back cast plate 19.

It should be appreciated that a sealing gasket of asbestos or other suitable material is interposed and utilized in all the joints to prevent smoke, flue gases and products of combustion from escaping through such joints.

Such upper and lower side cast panels 5 and 7, bolted-together, define angled side walls providing strength and structural rigidity. Panel 5 is cast with central webbing 45 to provide thereby greater strength. Panel 5 has an upper flange 47, lower flange 49 and lateral flanges 51. Panel 7 is cast with central webbing 53 to provide thereby greater strength. Panel 7 has an upper flange 55, lower flange 57 and lateral flanges 59.

The lateral flanges 51 of the upper panels 5 are square and permit the upper panels to be bolted together, as shown, to define a flat wall surface, and to be bolted together with and in normal relationship to front plate 3 and back plate 9.

The lateral flanges 59 of the lower panels 7 are square and permit the lower panels 7 to be bolted together, as shown, to define a flat wall surface, and to be bolted together with and in normal relationship to front plate 3 and back plate 9.

The upper and lower flanges 47 and 49 of panel 5 are tapered, as are the upper and lower flanges 55 and 57 of panel 7. Tapered lower flange 49 of panel 5 mating with tapered upper flange 55 of panel 7 are bolted together and define an obtuse interior angle and, hence, are tapered at an angle greater than 45°. FIG. 1.B. shows such an assembled joint bolted together with a nut 61 and bolt 63 with interposed washers that are tapered to allow bolt 63 to be lined up square to prevent cracking of a flange through non-uniform pressure that would otherwise be exerted.

The lower front cast plate 15, lower side panels 17 and lower back cast plate 19 have holes aligned with tapped holes to permit fixed assembly by means of cap screws engaged with such tapped holes.

The tapered lower flanges 57 of panels 7 are fixed to lower side panels 17 by means of cap screws, disposed through holes aligned with tapped holes, and engaged with such tapped holes.

Viewed in FIG. 1. in the direction from front plate 3 to back plate 9, the top cast panels 11 have squared front and rear flanges 67 and 69, and tapered lateral flanges 71. The top panel 11 is cast with criss-crossed webbing 73 to provide thereby greater strength.

The front flange 67 being square permits same to be bolted together with and in normal relationship to the front plate 3; and the rear flange 69 being square permits same to be bolted together with and in normal relationship to the back plate 9. Likewise the square front and rear flanges 67 and 69 permit same to be bolted together to define a flat top wall surface.

The tapered upper flange 47 of upper panel 5 mating with the tapered lateral flange 71 of top panel 11 are bolted together to define an obtuse interior angle and, hence, are tapered at an angle greater than 45°.

The elbowed flue 33 is cast in two flanged halves having interposed sealing gasket and bolted together. Such bolted-together two halves define a flanged joint 75 on one end having interposed sealing gasket and bolted to the upper back plate 9; and define a flanged joint 77 on the other end having interposed sealing gasket to which is bolted the smoke pipe cast ring 35.

Such tapered upper and lower panels 5 and 7 define angled side walls. The diverging lower panels 5 permit fire brick 79 to lie in place against such diverging side walls of lower panels 5 better than were the lower panels 5 to define a vertical wall. Such fire brick 79, so disposed and employed, reflects the heat upward off such fire brick 79.

This invention is directed to improvements in coal and wood heating devices, and more particularly to the panel castings. The principle of the invention is that such panel castings are allowed to expand and contract with the extreme temperature changes in the combustion chamber.

These castings will expand separately, independent of each other and of one another, and as much as a thirty-second of an inch to a square foot of surface panel depending upon the temperature changes and depending upon where a particular panel casting is located in the assembled heating device. Naturally, the upper side cast panels 5 and the top cast panels 11 get much hotter than the lower side cast panels 7 or the lower side panels 17 which define the ashpit.

Such separate cast panels 5, 7 and 11 prevent any cracking of the stove wall construction that has occurred in the other types of one or two-piece constructed stoves now on the market. Even with the sheet metal heating units now available, they still buckle and render because of temperature changes. Because of welded construction that many of such prior-art units use, there is no give to the sheet metal upon expansion and contraction. Such heating units warp drastically and some burn out within two to three years of use. By practicing applicant's invention and using separate, smaller cast panels, these discussed problems are eliminated and will thereby provide a much longer stove life, perhaps as long as 30 to 40 years.

Such panels 5, 7 and 11 can be replaced easily if ever needed and this heating device can be made larger at any time by using more panels to extend the length.

The upper half of the combustion chamber, defined by the upper side cast panels 5, converges thereby forcing the heat reflected upward from the fire brick 79 to be concentrated and maintained by such converging upper side cast panels 5 and with such heat being further concentrated and maintained by the flat top wall defined by the top cast panels 11. Such upper half of the combustion chamber is not lined with fire brick 79.

The mating upper flange 47 of panel 5 and lateral flange 71 of panel 11, at the top corner of the heating device 1 where the heat is the greatest, are tapered to greater than 45-degree angles allowing each casting to move against each other without building up great pressure upward and outward. Such construction allows a certain measure of slippage between the cast panels 5 and 11 due to expansion and contraction of the heated castings.

The middle joint connections, defined by bolted-together flanges 49 and 55 of the respective side panels 5 and 7, are not tapered as much as at the top corner of such heating device 1 because the heat is not as great as at the top, therefore, the amount of pressure exerted on these joints is reduced.

The reason the elbowed flue 33 is cast in two pieces is because it gets the hottest of any casting in the heating device for reason of its location at the top back thereof, combined with the smoke and gases passing through it. Such two-piece construction allows the two-piece elbowed flue 33 to shift with the changes in heat.

Figure 3:
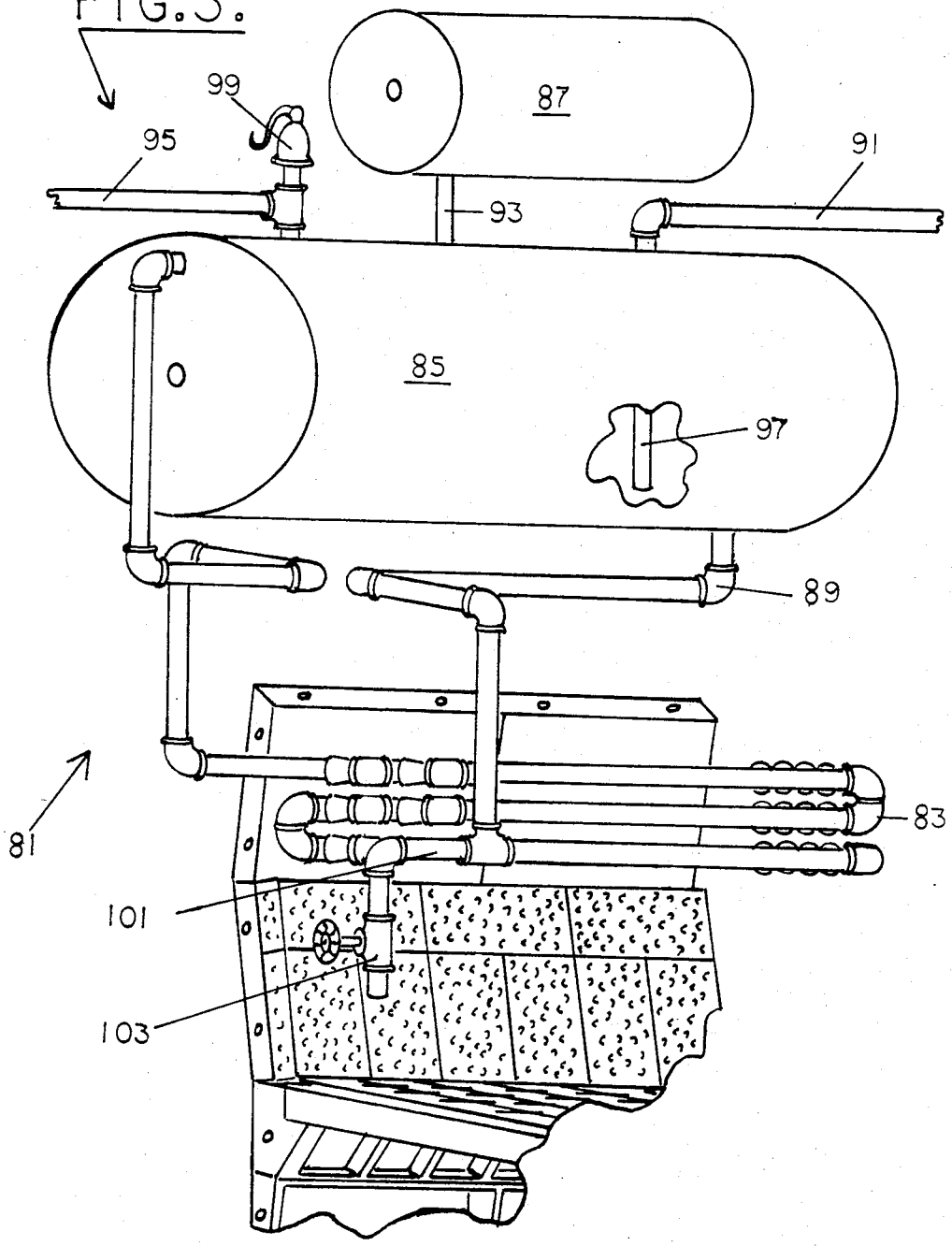
FIG. 3 is a perspective view of the hot-water boiler.

In FIG. 3. of the drawings, reference numeral 81 generally refers to the hot-water boiler. Boiler 81 incorporates the same structural components shown and described with respect to the heating device 1. Creosote build-up in the boiler 81 is significantly reduced because the internal heat in the boiler components is maintained far above the critical 270° F. temperature of creosote deposition from the flue gases.

A coil of layers of connected malleable steel water tubes 83 is inserted into the top area of the combustion chamber above the fire brick 79. By forcing the heat to concentrate in a smaller area at the top of the combustion chamber, the tubes 83 are more quickly and efficiently heated. Because the water is contained in tubes 83 of $1\frac{1}{2}''$ diameter or less located at the top of such combustion chamber where the heat is concentrated, such intense heat quickly heats the cold water in such tubes 83 and does not allow any creosote to form on the tubes 83. In addition, because the boiler 81 is a cast unit, the heat is maintained at a more constant level longer which is inherent in cast construction. This additional factor also prevents creosote from forming.

A holding tank 85 and expansion tank 87 are horizontally disposed, as shown, and are operatively connected with the steel water tubes 83, as shown, with such arranged and constructed boiler 81 functioning as a gravitation circulation system which needs no water circulator or pump of any kind.

Cold water will descend from the bottom of the holding tank 85 via interconnected pipe 89 to the bottom layer of the water-tube coil 83. Concentrated heat from the combustion chamber heats the water in the tubes 83 rapidly. Automatically, the heated water circulates and rises from tube layer to tube layer and thence out of the top tube layer of the water tubes 83 to the top of the holding tank 85 to the end that is opposite from the incoming cold-water supply line 91.

The expansion tank 87 above the holding tank 85 takes up any excess pressure resulting from water expansion. Holding tank 85 is connected to expansion tank 87 by means of pipe 93.

There is no creosote build-up in this type of suspended holding-tank water-heating boiler 81 because the holding tank 85 is well away from the fire and no sweating of the holding tank 85 occurs. The only amount of water that comes into contact with the fire in the combustion chamber is in the $1\frac{1}{2}''$ diameter tubes 83; therefore, there is no creosote build-up because the temperature in the water tubes 83 remain above the critical creosote deposition temperature.

The heated hot water can be piped from the top of the holding tank 85 via pipe 95 to radiation systems of many types also through a gravitation circulation system. The water returns to the top cold-water entry end of the holding tank 85 via its supply line 91. By using a dip tube 97, the cold water is forced directly to the bottom of the tank 85, mushrooming against the bottom of such holding tank 85. This cold water returns via cold-water pipe 89 to the bottom layer of the water-tube coil 83 to be reheated. Such use of the dip tube 97 prevents this cold water returning to the holding tank 85 from cooling the large amount of hot water in the upper section of the tank 85.

Heat from the fire in the combustion chamber controls the circulation of the water from the holding tank 85 into the water-tube coil 83 and back to the holding tank 85. The hot water can then flow from the top of the holding tank 85 as needed, up through another gravitation radiation system and return to the holding tank 85 using a thermostatic automatic valve (not shown) to control the upper room temperatures.

A pressure relief valve 99 is located at the top of the holding tank 85 on the radiation-system connecting pipe 95 to minimize and release any excessive high pressure.

On the bottom tube layer of water-tube coil 83 is a pipe 101 extending through the built-up wall of boiler 81 with a dump drain valve 103 to drain the water system when needed.

Figure 4:
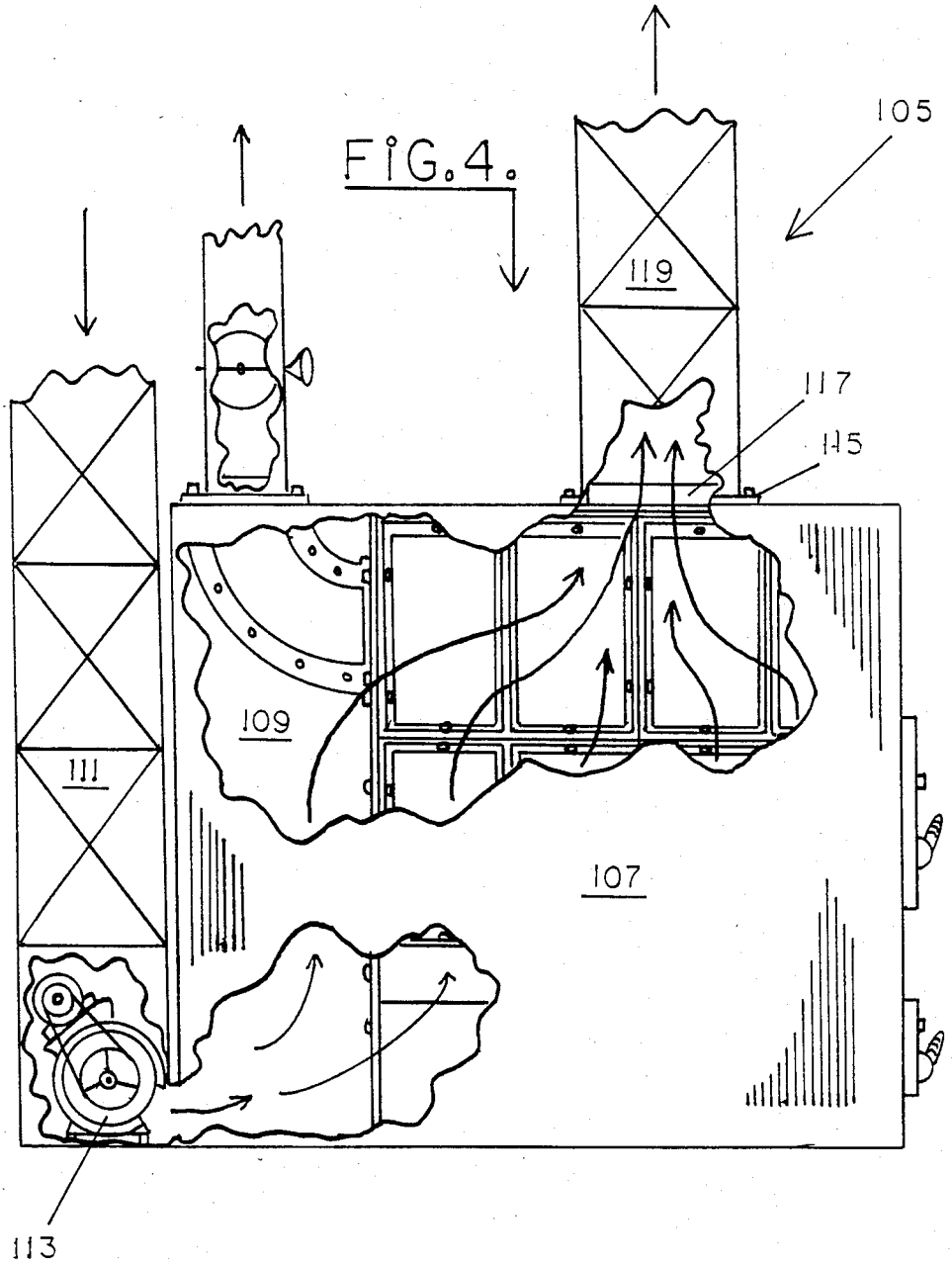
FIG. 4 is a side elevation of the hot-air furnace.

In FIG. 4. of the drawings, reference numeral 105 generally refers to the hot-air furnace. Hot-air furnace 105 incorporates the same structural components shown and described with respect to the heating device 1, but in addition is encased with a sheet-metal plenum 107 defining a plenum chamber 109 through which cold air directed down cold-air return 111 is forced into such plenum chamber 109 by means of a blower fan 113 communicating with cold-air return 111 and plenum chamber 109. Such cold air is forced upwards around the walls of the radiant heating device and is thereby heated. Such cool air returning to the furnace 105 enters at the bottom rear of the furnace 105 more or less against the ashpit castings defined by lower side panels 17 and lower back cast plate 19 and thence is heated as it rises against the heated castings defined by the upper and lower side cast panels 5 and 7, and the elbowed flue 33. Thus, the cold air entering at the bottom rear of the furnace 105 does not cool down such heated castings.

Plenum chamber 109 communicates with a square collar 115 bolted directly to the top of such sheet-metal plenum 107. Collar 115 has an upstanding male vertical lip 117 received in a leader 119 to conduct such heated air to adjacent rooms.

It is also within the concept of this invention to combine the structures of the embodiment shown and described with respect to the hot-water boiler 81 and the hot-air furnace 105.

It is also within the concept of this invention to combine the structures of the embodiment shown and described with respect to the hot-water boiler 81 and the hot-air furnace 105.

In the prior art, problems have been encountered in piping cool air from a cold-air return against a water-jacketed furnace functioning as a boiler because the cool air cools the water jacket, thus forming creosote on the inside of the combustion chamber.

However, such problems do not happen with the combined hot-water boiler 81 and hot-air furnace 105 because the water is contained within the coil of water tubes 83 in the upper part of the combustion chamber. Hence, no cool air comes into contact with any of the water tubes 83. The cast panel construction of the combustion chamber further reduces heat loss that otherwise would occur with a heating device of thinner wall construction because the heavier construction of the cast panels operates to retain heat longer. The combined structure of the hot-water boiler and hot-air furnace is likewise creosote-free.

Having thusly described my invention, I claim:

1. A heating device of assembled cast panel construction comprising: an upper front cast plate, upper and lower side cast panels, an upper back cast plate, top cast panels, grates, a lower front cast plate, lower side panels, a lower back cast plate, a flue and fire brick; said upper front cast plate, upper and lower side cast panels, upper back cast plate, top cast panels and grates defining a combustion chamber, said lower front cast plate, lower side panels and lower back cast plate defining an ashpit, said flue communicating with said combustion chamber to exhaust therefrom smoke, flue gases and products of combustion, said upper side cast panels having upper flanges, lower flanges and lateral flanges, said lower side cast panels having upper flanges, lower flanges and lateral flanges, said lateral flanges of said upper side cast panels being square, said upper side cast panels being joined together at their said lateral flanges and presenting and defining flat surfaces inwardly facing said combustion chamber, said lateral flanges of said upper side cast panels being joined together with and in normal relationship with said upper front cast plate, said lateral flanges of said upper side cast panels being joined together with and in normal relationship with said upper back cast plate, said lateral flanges of said lower side cast panels being square, said lower side cast panels being joined together at their said lateral flanges and presenting and defining flat surfaces inwardly facing said combustion chamber, said lateral flanges of said lower side cast panels being joined together with and in normal relationship with said upper front cast plate, said lateral flanges of said lower side cast panels being joined together with and in normal relationship with said upper back cast plate, said upper and lower flanges of said upper side cast panels being tapered, said upper and lower flanges of said lower side cast panels being tapered, said lower flanges of said upper side cast panels being joined together with said upper flanges of said lower side cast panels, said lower side cast panels, as joined together, diverging upwardly and outwardly, said upper side cast panels, as joined together, converging upwardly and inwardly, said flat surfaces of said lower side cast panels and upper side cast panels, as joined together, defining obtuse interior angles, said top cast panels having front and rear flanges, and lateral flanges, said front and rear flanges of said top cast panels being square, said lateral flanges of said top cast panels being tapered, said top cast panels being joined together at their said front and rear flanges and presenting and defining a horizontal flat surface inwardly facing said combustion chamber, said front and rear flanges of said top cast panels being joined together with and in normal relationship with said upper front cast plate and upper back cast plate, respectively, said tapered upper flanges of said upper side cast panels being joined together with said tapered lateral flanges of said top cast panels, said upper side cast panels and top cast panels, as joined together, defining obtuse interior angles, said fire brick lying in place in corresponding diverging relationship against said inward flat surfaces of each of said diverging lower side cast panels to reflect heat upward, said converging inward flat surfaces of said upper side cast panels defining the upper half of said combustion chamber, said upper back cast plate having an upper half corresponding with said upper half of said combustion chamber, said upper half of said combustion chamber and said upper half of said upper back cast plate having corresponding middle regions, said middle region of said upper back cast plate mounting said flue for communication with said middle region of said upper half of said combustion chamber, said converging inward flat surfaces of said upper side cast panels forcing such heat to concentrate and maintain itself in said upper half of said combustion chamber above the creosote deposition temperature of the flue gases to prevent the formation of creosote, said horizontal flat surface of said top cast panels inwardly presented and facing said combustion chamber stopping such heat and further concentrating and maintaining such heat in said upper half of said combustion chamber for maximum heat exchange, a coil of layers of connected water tubes, and said coil of water tubes is disposed in said upper half of said combustion chamber, and said flue and its location at said middle region of said upper back cast plate cooperating in such stopping of such heat and further concentrating and maintaining such heat in said upper half of said combustion chamber by delaying the exhaustion of such heat from said upper half of said combustion chamber.

2. A heating device in accordance with claim 1, wherein said lower flanges of said upper side cast panels and said upper flanges of said lower side cast panels are tapered at angles greater than 45°.

3. A heating device in accordance with claim 1, wherein said upper flanges of said upper side cast panels and said lateral flanges of said top cast panels are tapered at angles greater than 45°.

4. A heating device in accordance with claim 1, wherein said upper and lower side cast panels and said top cast panels have webbing thereby providing and imparting greater strength.

5. A heating device in accordance with claim 1, wherein said upper front cast plate has a feed door to provide access to said combustion chamber.

6. A heating device in accordance with claim 1, wherein said lower front cast plate has an ashpit door providing access to said ashpit.

7. A heating device in accordance with claim 1, further comprising a holding tank and an expansion tank, said coil of water tubes being operatively connected to said holding tank and said expansion tank being operatively connected to said holding tank.

8. A heating device in accordance with claim 1, wherein said heating device has a holding tank and an expansion tank, said holding tank being disposed above said coil of water tubes and being operatively connected thereto, and said expansion tank being disposed above said holding tank and being operatively connected thereto.

9. A heating device in accordance with claim 1, further comprising a holding tank, an expansion tank, a cold-water pipe interconnecting said holding tank and coil of water tubes, an incoming cold-water supply line, a pipe interconnecting said holding tank and said expansion tank, a pipe connecting a radiation system, and a dip tube; said coil of water tubes being disposed in said upper half of said combustion chamber, said coil of water tubes having a bottom layer, said cold-water pipe interconnecting said holding tank and coil of water tubes to have cold water descend from the bottom of said holding tank to said bottom layer of said coil of water tubes, water heated in said coil of water tubes being conducted to the top of said holding tank, said pipe connecting said radiation system conducting hot water from said top of said holding tank, and said dip tube forcing cold water from said incoming cold-water supply line to said bottom of said holding tank.

10. A heating device in accordance with claim 1, wherein said heating device has a sheet metal plenum, a cold-air return and a blower fan; said sheet metal plenum defining a plenum chamber, said blower fan communicating with said cold-air return and said plenum chamber, said blower fan directing cold air from said cold-air return to said plenum chamber, and said plenum chamber heating said cold air.

11. A heating device in accordance with claim 10, wherein said heating device has a collar and a leader, said collar being operatively connected to and communicating with said plenum chamber, said leader being operatively connected to and communicating with said collar, and said leader conducting heated air from said plenum chamber to adjacent rooms.

12. A heating device in accordance with claim 1, wherein said heating device has a sheet metal plenum, a cold-air return and a blower fan; said sheet metal plenum defining a plenum chamber, said blower fan communicating with said cold-air return and said plenum chamber, said blower fan directing cold air from said cold-air return and through said plenum chamber and said plenum chamber heating said cold air.

* * * * *